US006593897B1

(12) United States Patent
McConnell

(10) Patent No.: US 6,593,897 B1
(45) Date of Patent: Jul. 15, 2003

(54) WIRELESS GPS APPARATUS WITH INTEGRAL ANTENNA DEVICE

(75) Inventor: Richard J. McConnell, Rancho Cucamonga, CA (US)

(73) Assignee: Sirf Technology, Inc., San Jose, CA (US)

( * ) Notice: Subject to any disclaimer, the term of this patent is extended or adjusted under 35 U.S.C. 154(b) by 0 days.

(21) Appl. No.: 09/609,572

(22) Filed: Jun. 30, 2000

(51) Int. Cl.[7] ..... H01Q 1/52
(52) U.S. Cl. ..... 343/841; 343/702
(58) Field of Search ..... 343/702, 700 MS, 343/829, 845, 846, 848, 841, 895

(56) References Cited

U.S. PATENT DOCUMENTS

| | | | | |
|---|---|---|---|---|
| 4,121,218 A | | 10/1978 | Irwin et al. | 343/702 |
| 4,868,576 A | | 9/1989 | Johnson, Jr. | 343/702 |
| 5,161,255 A | * | 11/1992 | Tsuchiya | 455/345 |
| 5,589,840 A | | 12/1996 | Fujisawa | 343/718 |
| 5,661,495 A | | 8/1997 | Saldell | 343/702 |
| 5,699,319 A | | 12/1997 | Skrivervik | 368/10 |
| 5,831,577 A | * | 11/1998 | Nichols et al. | 342/357.03 |
| 5,973,646 A | | 10/1999 | Engblom | 343/702 |
| 6,031,494 A | * | 2/2000 | Okabe et al. | 343/702 |
| 6,100,855 A | * | 8/2000 | Vinson et al. | 343/846 |
| 6,272,349 B1 | * | 8/2001 | McGrath et al. | 455/456 |
| 6,342,869 B1 | * | 1/2002 | Edvardsson et al. | 343/841 |

* cited by examiner

*Primary Examiner*—Don Wong
*Assistant Examiner*—Shih-Chao Chen
(74) *Attorney, Agent, or Firm*—Shemwell Gregory & Courtney LLP

(57) ABSTRACT

A wireless apparatus includes an electrically conductive casing housing a ground plane and GPS receiver circuitry. The casing is electrically connected to the ground plane to form a first antenna element. The apparatus further includes a second antenna element located external the casing. The second antenna element may be configured as a wire filament in the form of a copper trace carried by a printed circuit board. The second antenna element is electrically coupled to the first antenna element and the GPS receiver circuitry. The first antenna element and second antenna element are configured and disposed relative to each other to form an antenna for receiving GPS signals.

11 Claims, 3 Drawing Sheets

WIRELESS GPS APPARATUS WITH INTEGRAL ANTENNA DEVICE

BACKGROUND OF THE INVENTION

1. Field of the Invention

The invention relates generally to a wireless apparatus with an integral antenna device and more particularly to a GPS instrument in which the combination of an encased ground plane and wire filament functions as an electrically short linear GPS antenna.

2. Description of Related Art

GPS antennas have historically been fabricated as circular polarized antennas using either quadrifilar helices or circular patches. In order to operate efficiently, these antennas must be properly oriented towards the sky. Circular polarized antennas degenerate into linear polarization near their horizon, accordingly, replacing these antennas with a linear antenna has little effect on the received signal strength of the satellites that would be in the linear operation region of the circular polarized antenna. The strength of the peak signals received will be less because the maximum gain of the linear antenna is 3 dB less than the maximum gain of a circularly polarized antenna. This loss of signal strength is a reasonable tradeoff given the low cost and simplicity of a linear antenna.

Many modern applications for GPS do not allow for the proper orientation of a circularly polarized antenna, and circular antenna performance below or behind the main lobe of the antenna pattern can be worse than that of a linear antenna. For example, a cellular phone with a GPS receiver may be positioned such that the telephone keypad is facing up or down, furthermore, the telephone may be carried in a pocket with the keypad in a vertical orientation. Positioning the telephone as such places the circularly polarized antenna facing up, down or toward the horizon. Thus the operational efficiency of a GPS receiver that receives signals through the circular polarized antenna of the cellular telephone is generally degraded due to the inappropriate physical orientation of the antenna.

A number of wireless communication devices with integral linear antennas currently exist. For example, cellular telephones employ an extendible antenna that uses shielded circuitry as a part of the antenna, along with a wire filament that can be straight, or electrically lengthened by inductively loading one end with a coiled portion of the antenna filament. Typical embodiments of these types of cellular telephones are presented in U.S. Pat. No. 4,868,576. The antennas used in the communication device assemblies presented in the prior art are usually made as large as possible to achieve broad bandwidth. Such large antennas are neither desirable nor practical for GPS devices, which in many applications are small sized.

Hence, those skilled in the art have recognized a need for a wireless apparatus having an integral GPS antenna that is physically small, inexpensive, and functional in arbitrary orientation. The present invention fulfils these needs and others.

SUMMARY OF THE INVENTION

Briefly and in general terms, the invention is directed to a wireless apparatus having an integral antenna for receiving GPS signals. The apparatus includes an electrically conductive casing housing a ground plane and GPS receiver circuitry. The casing is electrically connected to the ground plane to form a first antenna element. The apparatus further includes a second antenna element located external to the casing. The second antenna element is electrically coupled to the first antenna element and the GPS receiver circuitry. The first antenna element and second antenna element are configured and disposed relative to each other to form an antenna for receiving GPS signals.

In a detailed aspect, the apparatus further includes a printed circuit board at least partially housed within the casing. The ground plane and the GPS receiver circuitry are carried by the printed circuit board. In another detailed facet, a portion of the GPS receiver circuitry is electrically connected to the ground plane. In yet another facet, the ground plane is embedded within the printed circuit board and the casing is electrically connected to the ground plane through the printed circuit board. In another detailed aspect, the casing substantially confines RF leakage signals from the GPS receiver circuitry to the space within the casing.

In another detailed facet, the second antenna element is directly connected to the GPS receiver circuitry through a signal port. In yet another detailed aspect, the second antenna element is electrically coupled to the first antenna element and the GPS circuitry through an inductive element electrically connected to the casing at a first connection point and to the second antenna element at a second connection point. The second connection point is further connected to the GPS receiver circuitry through a signal port.

In still further detailed facets, the second antenna element comprises a straight conductive wire filament disposed relative the first antenna element such that the first antenna element and the second antenna element function as a dipole antenna. Alternatively, the second antenna element may comprise a wire filament formed in one of a meandering, spiral, L and U shape. In another detailed aspect, the second antenna element comprises a conductive element formed on the printed circuit board. In yet another detailed aspect, the conductive element is formed on a portion of the printed circuit board that extends beyond the casing.

These and other aspects and advantages of the invention will become apparent from the following detailed description and the accompanying drawings, which illustrate by way of example, the features of the invention.

DETAILED DESCRIPTION OF THE PREFERRED EMBODIMENTS

Figure 1:
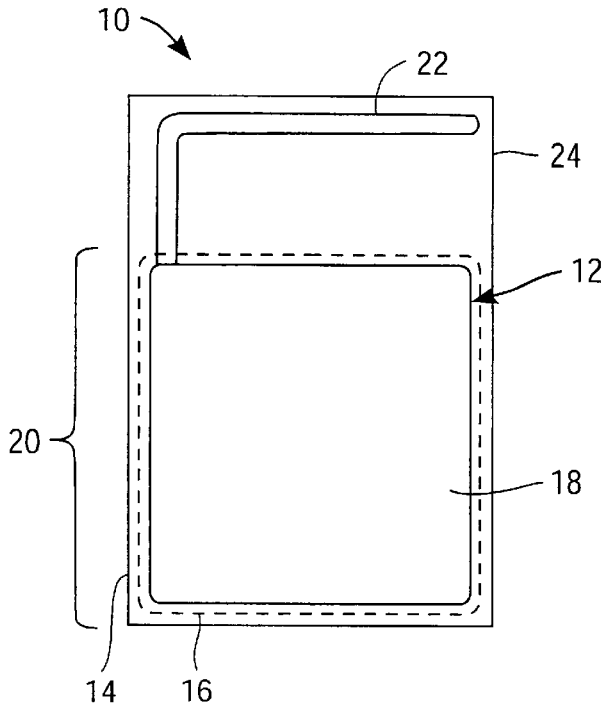
FIG. 1 is a front view of an apparatus having a GPS antenna comprising an L-shaped wire filament and a ground casing.
Figure 2:
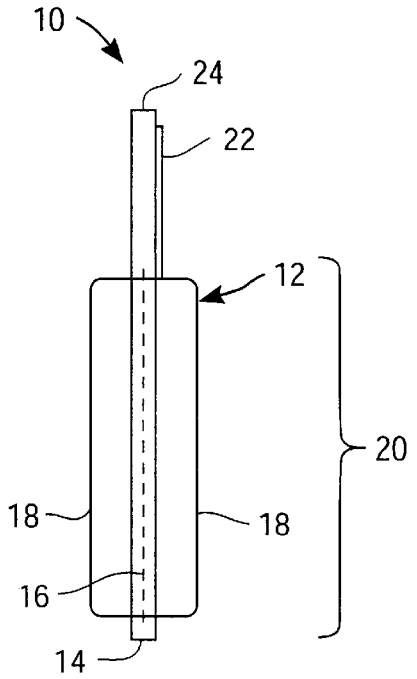
FIG. 2 is a side view of the apparatus of FIG. 1.

Referring now to the drawings, in which like reference numerals are used to designate like or corresponding elements among the several figures, in FIGS. 1 and 2, an apparatus 10 in accordance with the present invention comprises a casing 12 formed of a pair of electrically conductive shields 18. Partially housed within the casing 12 are a printed circuit board (PCB) 14, a ground plane 16 and GPS circuitry (not shown). The GPS circuitry is mounted on either side of the PCB 14 while the ground plane 16 is embedded within the PCB 14. In the embodiment of the invention depicted in FIGS. 1 and 2, the PCB 14 and ground plane 16 extend beyond the perimeter of the casing 12. In alternate embodiments, the PCB 14 and ground plane 16 may be entirely housed within the casing.

The shields 18 are electrically connected to the ground plane 16 at a plurality of locations around the perimeter of the shields. This electrical connection may be done using well known soldering techniques. The combination of the casing 12 and ground plane 16 form a ground casing 20 which functions as an electrically short linear antenna element referred to herein as a "first antenna element." For antenna design purposes the length of the first antenna element 20 is equivalent to the diagonal of the combination casing 12 and ground plane 16.

Figure 3:
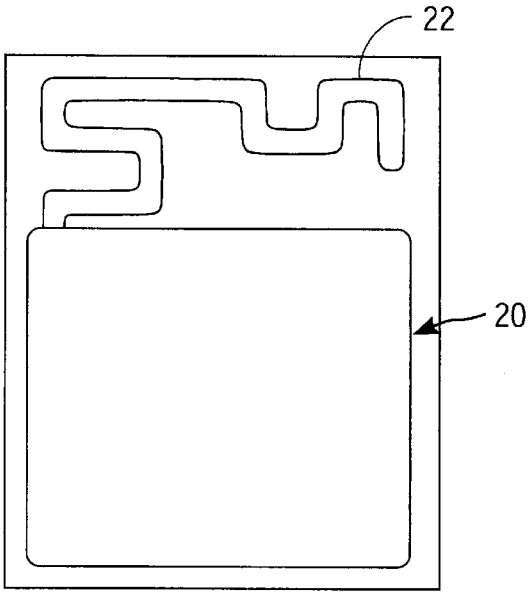
FIG. 3 is a front view of an apparatus having a GPS antenna comprising a meandering wire filament and a ground casing.
Figure 4:
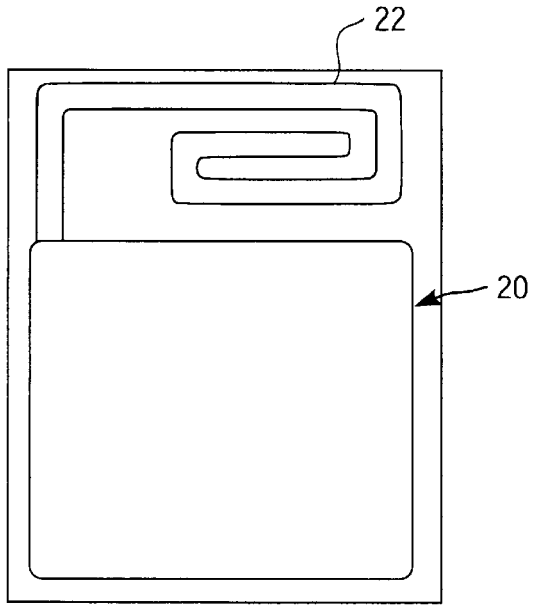
FIG. 4 is a front view of an apparatus having a GPS antenna comprising a spiral wire filament and a ground casing.

With continued reference to FIGS. 1 and 2, the apparatus 10 further includes a second antenna element 22. The second antenna element 22 may be configured as free standing metal stamping, a wire filament or, in a preferred embodiment, as a copper trace carried on a portion 24 of the surface of the PCB 14 that extends beyond the ground casing 20. In a preferred embodiment, the PCB 14 is formed of a fiberglass material. The copper trace 22 may take any of several shapes. The second antenna element 22 may be bent or coiled to decrease the physical area of the assembly. For example, with reference to FIGS. 1, 3 and 4, the copper trace 22 may be L-shaped (FIG. 1), meandering shaped (FIG. 3) or spiral shaped (FIG. 4). Although these shapes have an effect on the size of the second antenna element 22, they effectively produce the same functional results.

The first antenna element 20 interfaces with the second antenna element 22 to form a resonator that acts as a linear antenna which supplies the signal for the GPS circuitry. The actual length of the antenna is significantly less than a typical ½ wavelength antenna used for the GPS frequency. In a preferred embodiment, the first antenna element 20 and the second antenna element 22 lie substantially in the same plane. As previously mentioned, the shields 18 are formed of an electrically conductive material. During operation of the GPS circuitry, RF leakage from the GPS circuit components may occur. Such leakage may interfere with the operation of the antenna. The shields 18 are positioned on both sides of the PCB 14 to cover the GPS circuitry so as to limit RF leakage interference.

Figure 5:
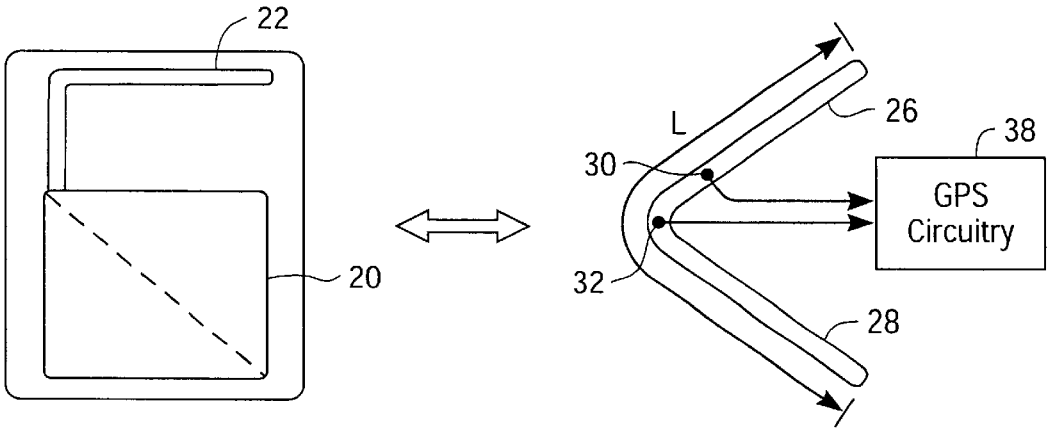
FIG. 5 is a representation of the apparatus of FIG. 1 modeled as a collapsed dipole wherein length L is electrically equivalent to ½ wavelength.

With reference to FIG. 5, the antenna may be modeled as a collapsed dipole. In this model, the top portion 26 corresponds to the first antenna element 22 while the bottom portion 28 corresponds to the second antenna element 20. As previously mentioned, the length of the ground casing diagonal 30 represents the length of the second antenna element 20 for antenna design purposes. Length L indicated in the model is electrically equivalent to ½ wavelength. Alternatively, with reference to FIG. 6, the antenna may be modeled as a large parallel inductor-capacitor resonator. In this model, R is the resistor formed by the radiation losses of the antenna.

Figure 6:
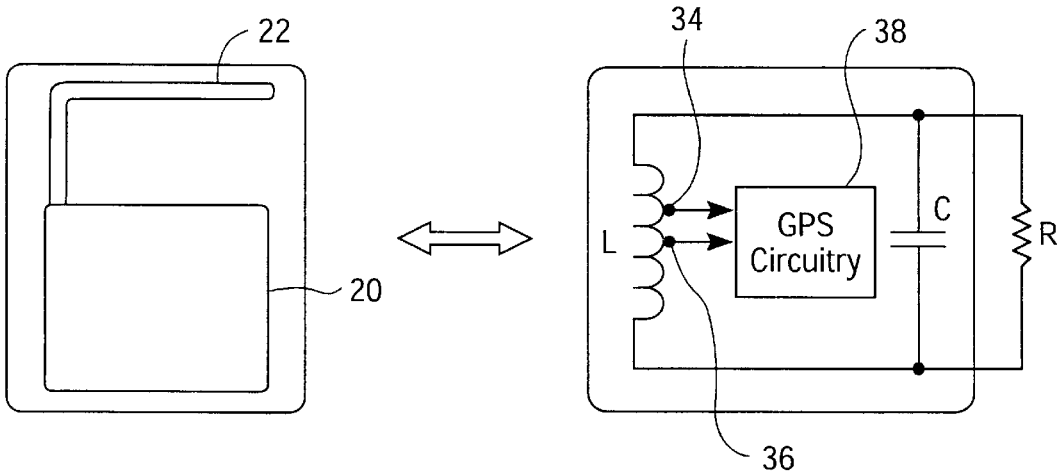
FIG. 6 is a representation of the apparatus of FIG. 1 modeled as a lossy inductor (L) and capacitor (C) wherein a resistor (R) is formed by the radiation losses of the GPS antenna.

In well known antenna design techniques a matching structure is typically employed to provide matching between the antenna and the GPS circuitry for efficient transfer of energy. Both of the equivalent models depicted in FIGS. 5 and 6 show a matching structure in the form of a tap. In FIG. 5 this tap is represented by the gap between the two connection points 30, 32, while in FIG. 6 the gap between two connection points 34, 36 represents the tap. As described later below, the size of the gap may be adjusted to effectively match the antenna with the GPS circuitry 38.

Figure 7:
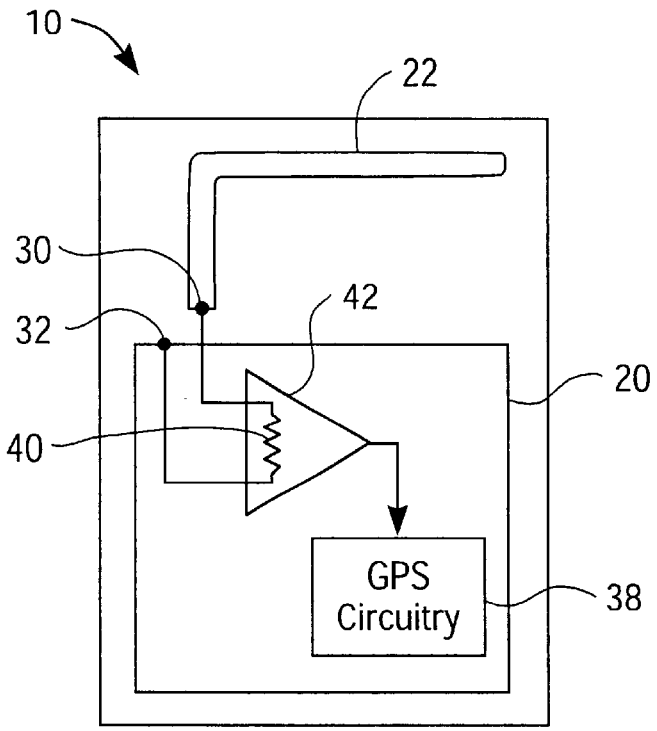
FIG. 7 is a schematic diagram of an apparatus having a GPS antenna comprising an L-shaped wire filament interfaced with a ground casing through the input port of GPS circuitry.

As shown in FIG. 7, however, a matching structure may not always be necessary. A signal from the antenna, comprised of wire filament 22 and ground casing 20, is developed between two connection points 30, 32. The length of the wire filament 22, the space between the filament and the ground casing 20 and the angle of the filament with respect to the ground casing is adjusted such that there is an efficient transfer of the signal to the effective input resistance 40 of the amplifier 42, which is the input port of the GPS circuitry 38. These adjustments are made using well known antenna design techniques.

Figure 8:
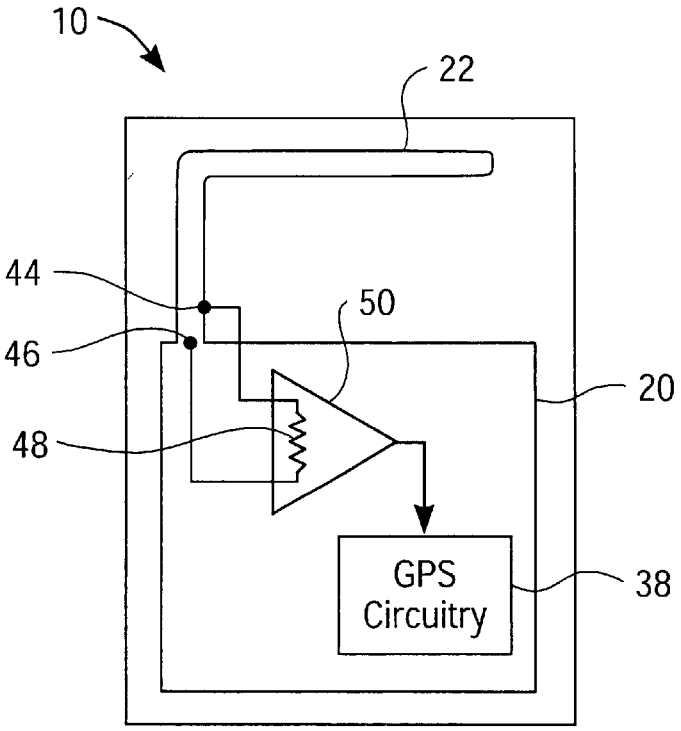
FIG. 8 is a schematic diagram of an apparatus having a GPS antenna comprising a U-shaped wire filament directly interfaced with a ground casing, wherein a portion of the wire filament functions as a matching structure.

With reference to FIG. 8, an apparatus 10 employing a matching structure is depicted. In this apparatus 10, the first antenna element 22 is directly electrically connected to the second antenna element 20. The signal from the antenna formed by the antenna elements 20, 22 is developed across two connection points 44, 46 and fed into the effective input resistance 48 of the amplifier 50. In this case, the length and orientation of the filament 22 is adjusted as previously explained, with reference to FIG. 7. As an additional adjustment variable, the location of the connection point 44 along the length of the filament 22 where the signal is tapped off may be moved to achieve optimum signal transfer. In this configuration, the matching structure is the tapped portion of filament 22 between the two connection points 44, 46.

While this invention has been described in conjunction with specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention as defined in the claims.

What is claimed is:

1. An apparatus for receiving GPS signals, said apparat comprising:

an electrically conductive casing housing a ground plane and GPS receiver circuitry, the casing electrically connected to the ground plane to form a first antenna element; and a second antenna element located external to the casing, the second antenna element electrically coupled to the first antenna element and the GPS receiver circuitry;

wherein said first antenna element and said second antenna element are configured and disposed relative to each other to form an antenna for receiving GPS signals.

2. The apparatus of claim 1 further comprising a printed circuit board at least partially housed within the casing, wherein the ground plane and the GPS receiver circuitry are carried by the printed circuit board.

3. The apparatus of claim 2 wherein a portion of the GPS receiver circuitry is electrically connected to the ground plane.

4. The apparatus of claim 2 wherein the ground plane is embedded within the printed circuit board and the casing is electrically connected to the ground plane through the printed circuit board.

5. The apparatus of claim 1 wherein the casing substantially confines RF leakage signals from the GPS receiver circuitry to the space within the casing.

6. The apparatus of claim 1 wherein the second antenna element is directly connected to the GPS receiver circuitry through a signal port.

7. The apparatus of claim 1 wherein the second antenna element is electrically coupled to the first antenna element and the GPS circuitry through an inductive element electrically connected to the casing at a first connection point and to the second antenna element at a second connection point; wherein the second connection point is further connected to the GPS receiver circuitry through a signal port.

8. The apparatus of claim 1 wherein the second antenna element comprises a straight conductive wire filament disposed relative the first antenna element such that the first antenna element and the second antenna element function as a dipole antenna.

9. The apparatus of claim 1 wherein the second antenna element comprises a wire filament formed in one of a meandering, spiral, L and U shape.

10. The apparatus of claim 2 wherein the second antenna element comprises a conductive element formed on the printed circuit board.

11. The apparatus of claim 10 wherein the conductive element is formed on a portion of the printed circuit board that extends beyond the casing.

* * * * *